US009618269B2

(12) United States Patent
Kikuchi et al.

(10) Patent No.: US 9,618,269 B2
(45) Date of Patent: Apr. 11, 2017

(54) HEAT EXCHANGER WITH TUBE ARRANGEMENT FOR AIR CONDITIONER

(75) Inventors: Yoshimasa Kikuchi, Sakai (JP); Kanji Akai, Sakai (JP); Yoshio Oritani, Sakai (JP); Hideki Sawamizu, Sakai (JP); Masanori Jindou, Sakai (JP); Yoshiharu Michitsuji, Sakai (JP)

(73) Assignee: DAIKIN INDUSTRIES, LTD., Osaka-shi (JP)

( * ) Notice: Subject to any disclaimer, the term of this patent is extended or adjusted under 35 U.S.C. 154(b) by 537 days.

(21) Appl. No.: 13/578,995

(22) PCT Filed: Feb. 2, 2011

(86) PCT No.: PCT/JP2011/000583

§ 371 (c)(1),
(2), (4) Date: Aug. 14, 2012

(87) PCT Pub. No.: WO2011/099256

PCT Pub. Date: Aug. 18, 2011

(65) Prior Publication Data

US 2012/0318487 A1 Dec. 20, 2012

(30) Foreign Application Priority Data

Feb. 15, 2010 (JP) ..... 2010-030649

(51) Int. Cl.
*F28F 9/02* (2006.01)
*F28D 1/047* (2006.01)
(Continued)

(52) U.S. Cl.
CPC ..... *F28D 1/0477* (2013.01); *F24F 1/0007* (2013.01); *F24F 1/0059* (2013.01);
(Continued)

(58) Field of Classification Search
CPC . F28D 11/02; F28D 11/04; F28D 9/04; F28D 15/0208; F28D 1/0477; F28F 7/02;
(Continued)

(56) References Cited

U.S. PATENT DOCUMENTS 4,089,368 A * 5/1978 Bell et al. ..... 165/139
4,114,397 A * 9/1978 Takahashi ..... B60H 1/00485 165/158

(Continued)

FOREIGN PATENT DOCUMENTS

EP 1 548 387 A1 6/2005
JP 5-18612 A 1/1993

(Continued)

*Primary Examiner* — Len Tran
*Assistant Examiner* — Gordon Jones
(74) *Attorney, Agent, or Firm* — Birch, Stewart, Kolasch & Birch, LLP

(57) ABSTRACT

A heat exchanger includes a plurality of refrigerant tubes. In a flow divider, a part of a plurality of capillary tubes is connected to an open end portion on a side of a front tube plate, and a remainder of the plurality of the capillary tubes is connected to an open end portion on a side of a rear tube plate. The plurality of refrigerant tubes include even number refrigerant tubes constituted by an even number of heat transfer tube portions and odd number refrigerant tubes constituted by an odd number of heat transfer tube portions.

5 Claims, 10 Drawing Sheets

(51) Int. Cl.
*F24F 1/00* (2011.01)
*F25B 13/00* (2006.01)

(52) U.S. Cl.
CPC .... *F28F 9/0275* (2013.01); *F24F 2001/0037* (2013.01); *F25B 13/00* (2013.01); *F28F 2250/06* (2013.01)

(58) Field of Classification Search
CPC ..... F28F 3/086; F28F 2250/06; F28F 9/0275; F24F 2001/0037; F24F 1/0059; F24F 1/0007; F25B 13/00
USPC ..... 165/150, 125, 174; 62/525
See application file for complete search history.

(56) References Cited

U.S. PATENT DOCUMENTS 4,554,968 A * 11/1985 Haas ..... 165/144
5,065,586 A * 11/1991 Shapiro-Baruch ..... F24F 3/14 62/324.1
5,660,056 A * 8/1997 Arai et al. ..... 62/324.6
5,983,998 A * 11/1999 Kim ..... 165/150
6,354,367 B1 * 3/2002 Gong et al. ..... 165/125
6,381,974 B1 5/2002 Hwang et al.
7,318,470 B2 * 1/2008 Demuth ..... F28D 1/0478 165/144
2006/0048928 A1 * 3/2006 Maezawa et al. ..... 165/173
2008/0282725 A1 * 11/2008 Ishibashi ..... F24F 1/0007 62/426

FOREIGN PATENT DOCUMENTS

JP 9-229467 A 9/1997
JP 8-219493 A 8/1998
JP 2001-263702 A 9/2001
JP 2001-304791 A 10/2001
JP 2002-181487 A 6/2002
JP 2004-279029 A 10/2004
JP 2007-278676 A 10/2007
JP 2008-121984 A 5/2008
JP 2010-78289 A 4/2010
KR 10-1997-0066492 A 10/1997

* cited by examiner

HEAT EXCHANGER WITH TUBE ARRANGEMENT FOR AIR CONDITIONER

TECHNICAL FIELD

The present invention relates to a heat exchanger for an air conditioner.

BACKGROUND ART

Conventionally, cross fin-type heat exchangers are widely used as heat exchangers for air conditioners. A cross fin-type heat exchanger comprises a plurality of fins arranged at regular intervals and a plurality of refrigerant tubes (heat transfer tubes) that penetrate the fins. Air suctioned into a chassis of the air conditioner is subjected to a heat exchange with a refrigerant that flows through the refrigerant tubes while passing through gaps between the fins of the heat exchanger, and a temperature of the air is adjusted.

For example, Patent Document 1 discloses a heat exchanger comprising path count modifying means that modifies a path count of whichever has a higher liquid refrigerant ratio between a case where the heat exchanger functions as an evaporator and a case where the heat exchanger functions as a condenser. According to Patent Document 1, a heat exchanger which provides an efficient heat exchanging performance in both cooling and heating operations can be provided.

Patent Document 1: Japanese Patent Application Laid-open No. 2007-278676

Characteristics (for example, wind speed) of a flow of air passing through fins of a heat exchanger is not uniform throughout the entire heat exchanger and varies from portion to portion. However, with the heat exchanger described in Patent Document 1, it is difficult to finely adjust heat exchanging performance for each portion in response to the variation in air flow.

SUMMARY OF THE INVENTION

The present invention has been made in consideration of the above, and an object thereof is to provide a heat exchanger that enables fine adjustment of a heat exchanging performance of the heat exchanger for each portion of the heat exchanger.

A heat exchanger according to the present invention is intended to be used in an air conditioner. The heat exchanger comprises a plurality of fins (73), a pair of tube plates (77) and (79), a plurality of refrigerant tubes (R), a flow divider (94), and a header (91). The plurality of fins (73) are disposed so that adjacent fins oppose each other across a gap. The pair of tube plates (77) and (79) is positioned at one end section and another end section in a direction of disposition of the plurality of fins (73). Each refrigerant tube (R) among the plurality of refrigerant tubes (R) comprises a plurality of heat transfer tube portions (P) which extend along the direction of disposition of the plurality of fins (73) between the pair of tube plates while in contact with the plurality of fins (73), and bent tube portions (U) which connect end portions of two heat transfer tube portions (P) to each other. Each refrigerant tube (R) has a pair of open end portions (E1) and (E2) which acts as an inlet and an outlet of a refrigerant. The flow divider (94) has a plurality of branching tubes (96). Each branching tube (96) is connected to one open end portion (E1) of the corresponding refrigerant tube (R). The header (91) includes a plurality of branching tubes (93). Each branching tube (93) is connected to the other open end portion (E2) of the corresponding refrigerant tube (R).

Each open end portion is disposed on the one tube plate (77) or the other tube plate (79). In the flow divider (94) or the header (91), a part of the plurality of branching tubes is connected to the open end portion on the side of the one tube plate (77), and a remainder of the plurality of branching tubes is connected to the open end portion on the side of the other tube plate (79). The plurality of refrigerant tubes (R) include an even number refrigerant tube R which has an even number of heat transfer tube portions (P) and an odd number refrigerant tube R which has an odd number of heat transfer tube portions (P).

DESCRIPTION OF EMBODIMENTS

Hereinafter, a heat exchanger 71 according to an embodiment of the present invention, an indoor unit 31 comprising the heat exchanger 71, and an air conditioner 81 will be described with reference to the drawings.

<Overall Structure of Air Conditioner>

Figure 1:
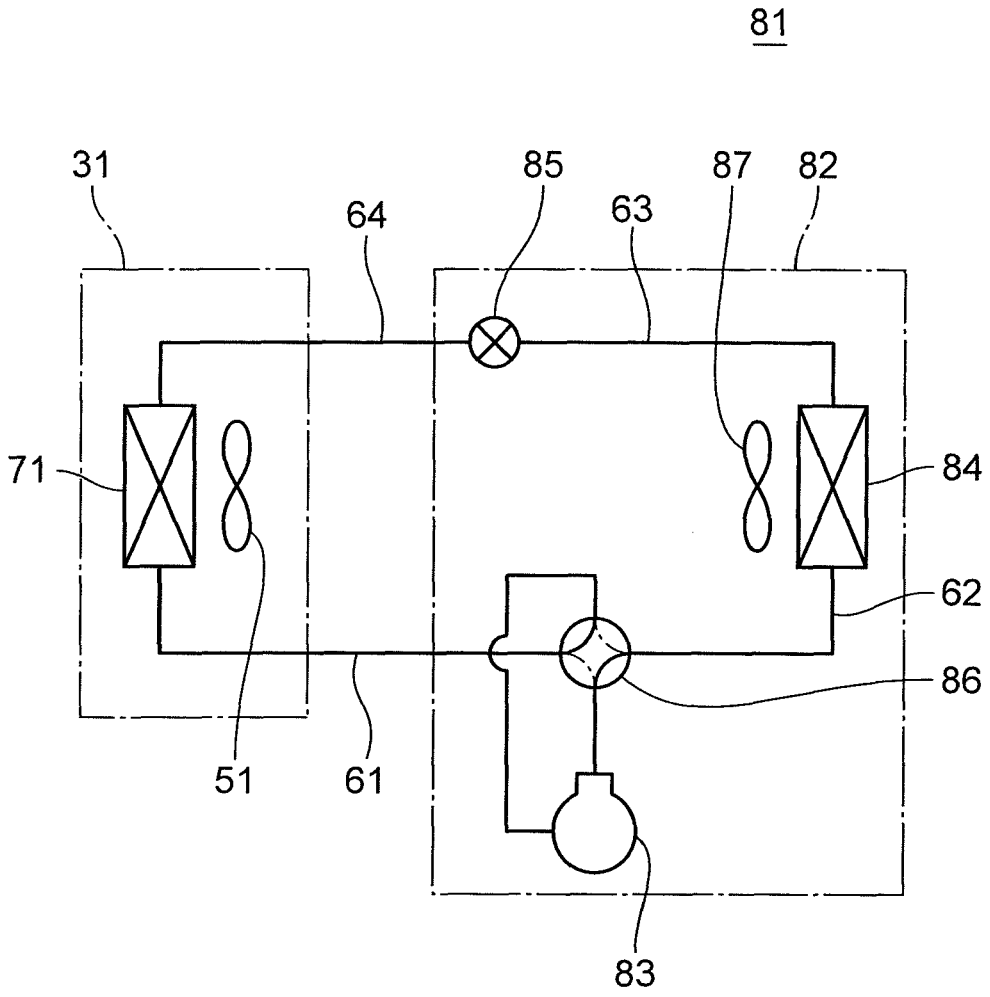
FIG. 1 is a configuration diagram of an air conditioner including an indoor unit and an outdoor unit comprising a heat exchanger according to an embodiment of the present invention.

As shown in FIG. 1, the air conditioner 81 comprises the indoor unit 31 and an outdoor unit 82. The air conditioner 81 comprises a refrigerant circuit including the heat exchanger 71 arranged in the indoor unit 31, a compressor 83, a heat exchanger 84, and an expansion valve 85 arranged in the outdoor unit 82, and pipings 61 to 64 that connect these components. The air conditioner 81 can be switched between a cooling operation and a heating operation by switching a flow of a refrigerant using a four-way selector valve 86 arranged at a part of the pipings of the refrigerant circuit. The indoor unit 31 comprises a fan 51 and the outdoor unit 82 comprises a fan 87.

<Structure of Indoor Unit>

Figure 2:
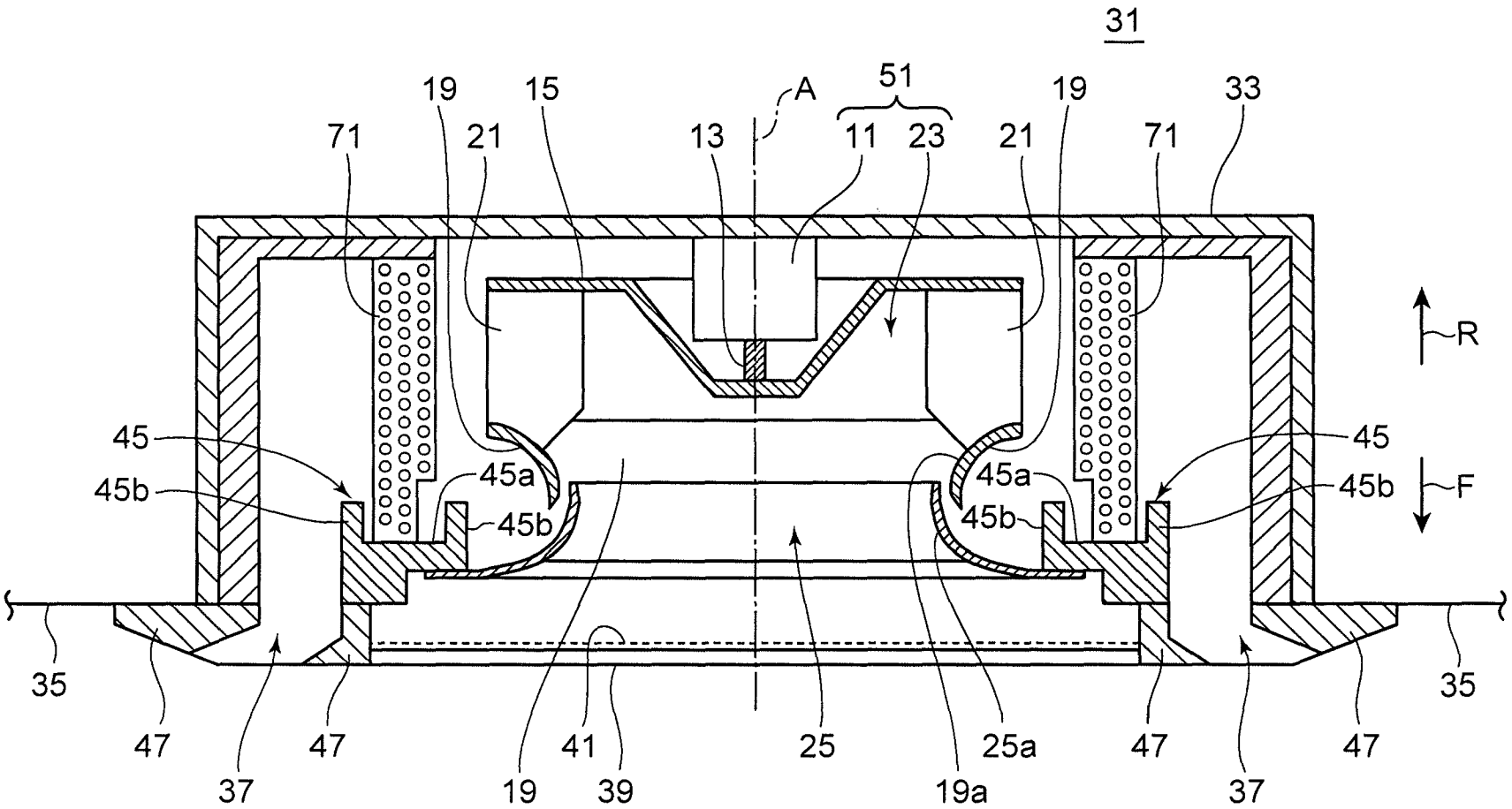
FIG. 2 is a cross sectional view showing an indoor unit comprising a heat exchanger according to the embodiment.

As shown in FIG. 2, the indoor unit 31 is a ceiling-embedded type and comprises an approximately rectangular parallelopiped chassis 33 that is embedded in an opening provided in the ceiling, and a decorative panel 47 mounted to a lower part of the chassis 33. The decorative panel 47 comprises a rectangular suction grill 39 provided at a central part of the decorative panel 47 and four elongated and rectangular air outlets 37 provided along respective sides of the suction grill 39.

Figure 3:
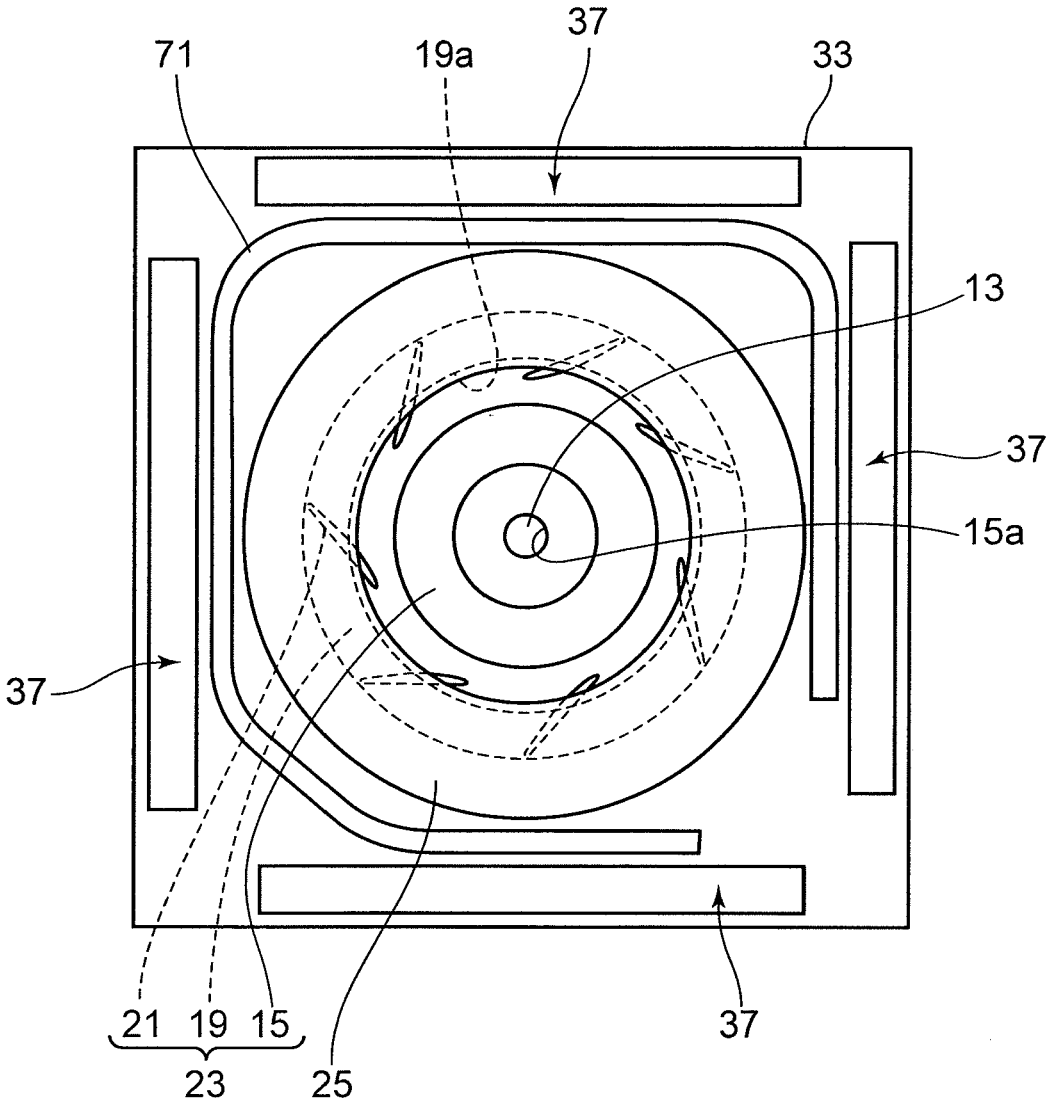
FIG. 3 is a bottom view showing a positional relationship among an impeller, a heat exchanger, and an air outlet in the indoor unit.

As shown in FIGS. 2 and 3, in the chassis 33, the indoor unit 31 comprises a centrifugal fan (turbo fan) 51, the heat exchanger 71, a drain pan 45, an air filter 41, a bell mouth 25, and the like. The centrifugal fan 51 comprises an impeller 23 and a fan motor 11. The fan motor 11 is fixed to an approximate center of a top plate of the chassis 33.

The heat exchanger 71 is arranged so as to enclose the impeller 23 in a state where the heat exchanger 71 rises upward from the dish-like drain pan 45 that extends along a lower end portion of the heat exchanger 71. The drain pan 45 receives water droplets created by the heat exchanger 71. The received water is discharged through a drainage path (not shown). Details of the heat exchanger 71 will be described later.

The air filter 41 is large enough to cover an entrance of the bell mouth 25 and is provided along the suction grill 39 between the bell mouth 25 and the suction grill 39.

The impeller 23 comprises a hub 15, a shroud 19, and a plurality of blades 21. The hub 15 is fixed to a lower end portion of a revolving shaft 13 of the fan motor 11. The shroud 19 is arranged so as to oppose a front F side of the hub 15 in an axial direction A of the revolving shaft 13. The shroud 19 comprises an air suction port 19*a* that opens in a circle that is centered around the revolving shaft 13. The plurality of blades 21 are arranged between the hub 15 and the shroud 19 at predetermined intervals along a circumferential direction of the air suction port 19*a*.

The bell mouth 25 is arranged so as to oppose a front F side of the shroud 19 in the axial direction A. The bell mouth 25 comprises a bell mouth main body and a flange portion which overhangs around the bell mouth main body from a front F side peripheral edge of the bell mouth main body. The bell mouth main body comprises a through hole 25*a* that penetrates in a front-back direction.

<Structure of Heat Exchanger>

Figure 4:
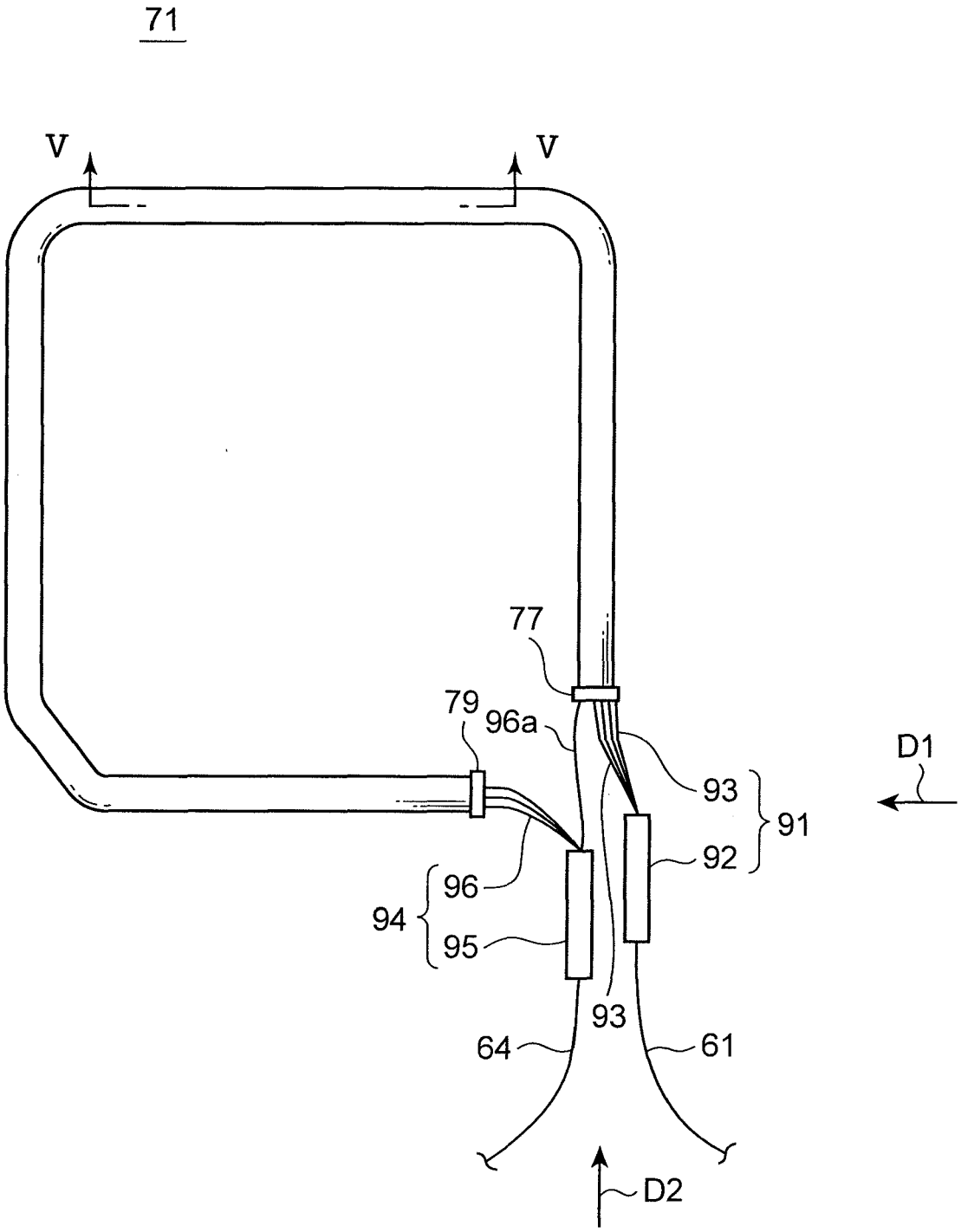
FIG. 4 is a bottom view showing a heat exchanger according to the embodiment.
Figure 5:
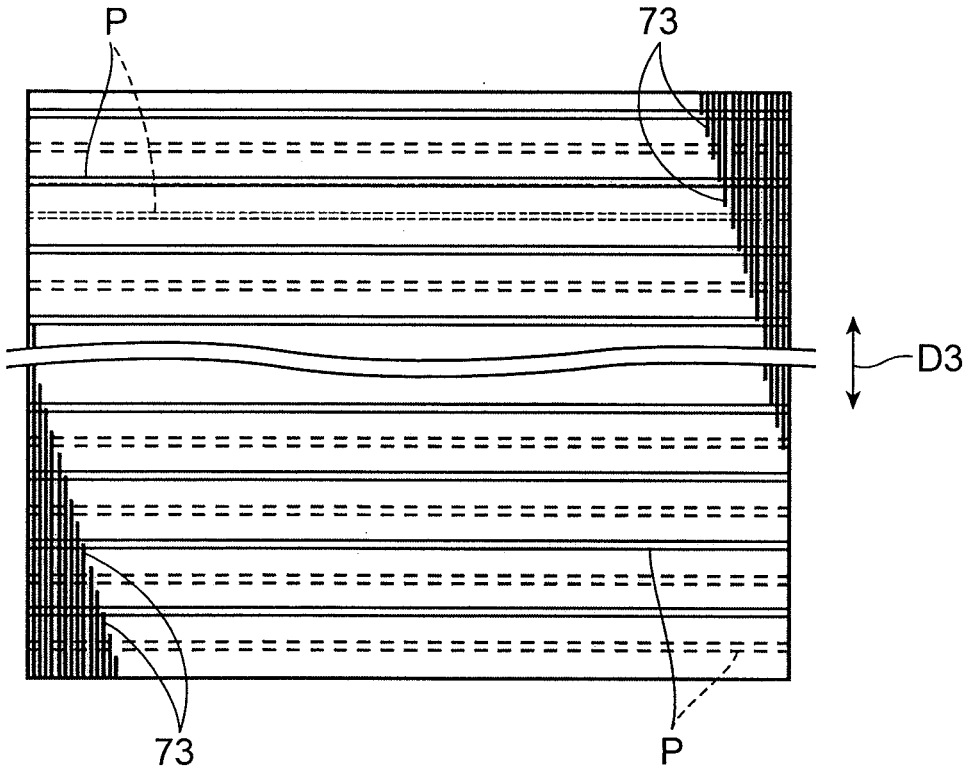
FIG. 5 is a cross sectional view taken along line V-V in FIG. 4.

As shown in FIGS. 4 and 5, the heat exchanger 71 is a cross fin-type heat exchanger comprising a plurality of laminar fins 73 and a plurality of heat transfer tube portions P inserted to through holes (not shown) formed on the respective fins 73. The plurality of fins 73 are disposed so that adjacent fins oppose each other across a gap. The heat exchanger 71 comprises a plate-like front tube plate 77 which is approximately parallel to a fin 73 positioned at one end section in a direction of disposition of the plurality of fins 73 and which is arranged so as to cover the fin 73. In addition, the heat exchanger 71 comprises a plate-like rear tube plate 79 which is approximately parallel to a fin 73 positioned at another end section in the direction of disposition and which is arranged so as to cover the fin 73.

Each heat transfer tube portion P extends between the front tube plate 77 and the rear tube plate 79 along the direction of disposition of the plurality of fins 73. Each heat transfer tube portion P is in contact with the plurality of fins 73.

The heat exchanger 71 further comprises a flow divider 94 and a header 91. The flow divider 94 comprises a flow divider main body 95 and a plurality of capillary tubes (branching tubes) 96 that branch from the flow divider main body 95. The flow divider 94 is connected to the piping 64 of the refrigerant circuit. The header 91 comprises a header main body 92 and a plurality of branching tubes 93 that branch from the header main body 92. The header 91 is connected to the piping 61 of the refrigerant circuit.

In the heat exchanger 71 according to the present embodiment, as shown in FIG. 4, a part of the plurality of the capillary tubes 96 of the flow divider 94 is connected to an open end portion E1 (to be described later) provided on the rear tube plate 79, and a remainder of the plurality of the capillary tubes 96 is connected to an open end portion E1 (to be described later) provided on the front tube plate 77. A specific description thereof will now be given.

Figure 6A:
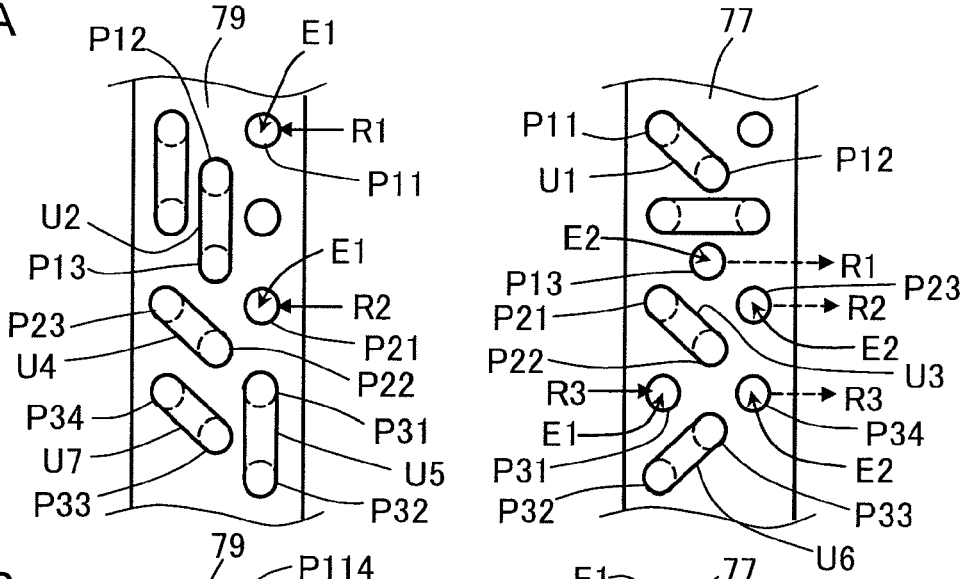
FIG. 6A is a schematic diagram for describing an arrangement example of refrigerant tubes in a heat exchanger according to the embodiment.

In FIG. 6A, a left-side diagram is a schematic side view of a part of the rear tube plate 79 from a side of a direction D1 in FIG. 4, and a right-side diagram is a schematic side view of a part of the front tube plate 77 from a side of a direction D2 in FIG. 4. FIG. 6A shows an example of a method of connecting the respective refrigerant tubes. Three refrigerant tubes (refrigerant paths) R (R1, R2, and R3) are shown in FIG. 6A.

Each refrigerant tube R comprises a pair of open end portions E1 and E2 that acts as an inlet and an outlet of a refrigerant and is a metal tube that has an internally consecutive refrigerant flow channel. For example, the plurality of refrigerant tubes R provided in the heat exchanger 71 may include a refrigerant tube R comprising two heat transfer tube portions P and one bent tube portion U that connects respective end portions of the two heat transfer tube portions P to each other, or a refrigerant tube R comprising three or more heat transfer tube portions P and a plurality of bent tube portions U that connect the three or more heat transfer tube portions P in series. In addition, the plurality of refrigerant tubes R may include a refrigerant tube R comprising a single heat transfer tube portion P or, in other words, a refrigerant tube R formed of a single straight tube. Each refrigerant tube R may be formed using a so-called hairpin in which a single tube is bent in a U-shape near its center, or formed by connecting respective end portions of straight tubes to each other with a U-shaped U-tube.

In this case, the heat transfer tube portion P refers to a portion of the refrigerant tube R other than the bent tube portion U. For example, in a case of a refrigerant tube R formed by connecting end portions of straight tubes to each other with a U-tube, the heat transfer tube portion P is the portion of the straight tube and the bent tube portion U is the portion of the U-tube. In addition, in a case of a refrigerant tube R formed using a hairpin, the bent tube portion U is a folded portion that is bent at a predetermined curvature radius, and the heat transfer tube portion P is a portion other than the folded portion.

Furthermore, the heat transfer tube portion P is extended between the front tube plate 77 and the rear tube plate 79. A length of a single heat transfer tube portion P is approximately equal to a flow channel length of the refrigerant tube R from the front tube plate 77 to the rear tube plate 79. Therefore, a flow channel length of the refrigerant tube R is a total value of a value obtained by multiplying a length of a heat transfer tube portion P by the number of heat transfer tube portions P and a value obtained by multiplying a length of a bent tube portion U by the number of bent tube portions U.

In FIG. 6A, the refrigerant tubes R1 and R2 are odd number refrigerant tubes constituted by three heat transfer tube portions P (an odd number of heat transfer tube portions P) and two bent tube portions U, and the refrigerant tube R3 is an even number refrigerant tube constituted by four heat transfer tube portions P (an even number of heat transfer tube portions P) and three bent tube portions U. There are fewer refrigerant tubes R3 with a greater flow channel length than the refrigerant tubes R (the refrigerant tubes R1, R2, and the like) with a shorter flow channel length.

Specifically, the refrigerant tube R1 is constituted by heat transfer tube portions P11, P12, and P13, a bent portion U1 that connects end portions of the heat transfer tube portion P11 and the heat transfer tube portion P12 to each other on a side of the front tube plate 77, and a bent portion U2 that connects end portions of the heat transfer tube portion P12 and the heat transfer tube portion P13 to each other on a side of the rear tube plate 79.

The refrigerant tube R2 is constituted by heat transfer tube portions P21, P22, and P23, a bent portion U3 that connects end portions of the heat transfer tube portion P21 and the heat transfer tube portion P22 to each other on a side of the front tube plate 77, and a bent portion U4 that connects end portions of the heat transfer tube portion P22 and the heat transfer tube portion P23 to each other on a side of the rear tube plate 79.

The refrigerant tube R3 is constituted by heat transfer tube portions P31, P32, P33, and P34, a bent portion U5 that connects end portions of the heat transfer tube portion P31 and the heat transfer tube portion P32 to each other on a side of the rear tube plate 79, a bent portion U6 that connects end portions of the heat transfer tube portion P32 and the heat transfer tube portion P33 to each other on a side of the front tube plate 77, and a bent portion U7 that connects end portions of the heat transfer tube portion P33 and the heat transfer tube portion P34 to each other on the side of the rear tube plate 79.

Among the plurality of capillary tubes 96 of the flow divider 94, one capillary tube 96*a* is connected to the open end portion E1 of the refrigerant tube R3 (an end portion of the heat transfer tube portion P31) provided on the front tube plate 77, and the other capillary tubes 96 are respectively connected to the open end portion E1 of the refrigerant tube R1 (an end portion of the heat transfer tube portion P11), the open end portion E1 of the refrigerant tube R2 (an end portion of the heat transfer tube portion P21), and the open end portions E1 of other refrigerant tubes R (not shown) provided on the rear tube plate 79 (refer to FIG. 4). The plurality of branching tubes 93 of the header 91 are respectively connected to the open end portions E2 of the refrigerant tubes R1, R2, and R3 and to the open end portion E2 of other refrigerant tubes R (not shown) provided on the front tube plate 77. The open end portions E2 of the respective refrigerant tubes R are all provided on the front tube plate 77.

Therefore, only the refrigerant tube R3 has an even number (four) of heat transfer tube portions P, and the other refrigerant tubes R have an odd number of heat transfer tube portions P. As shown, if L denotes an effective length of a single heat transfer tube portion P, a refrigerant tube R that is an odd multiple of the effective length L and a refrigerant tube R that is an even multiple of the effective length L can coexist in the heat exchanger 71 according to the present embodiment.

Figure 6B:
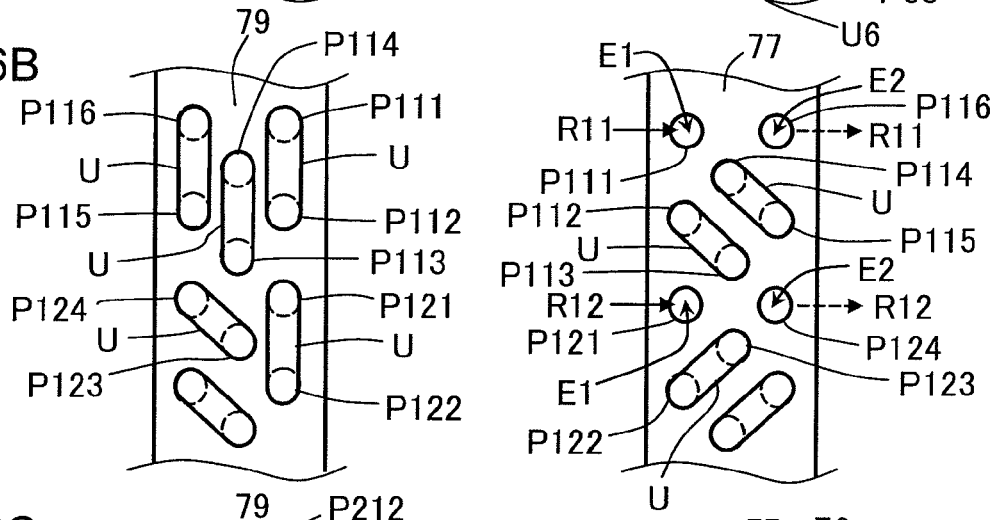
FIGS. 6B and 6C are schematic diagrams for describing an arrangement example of refrigerant tubes in a conventional heat exchanger.
Figure 6C:
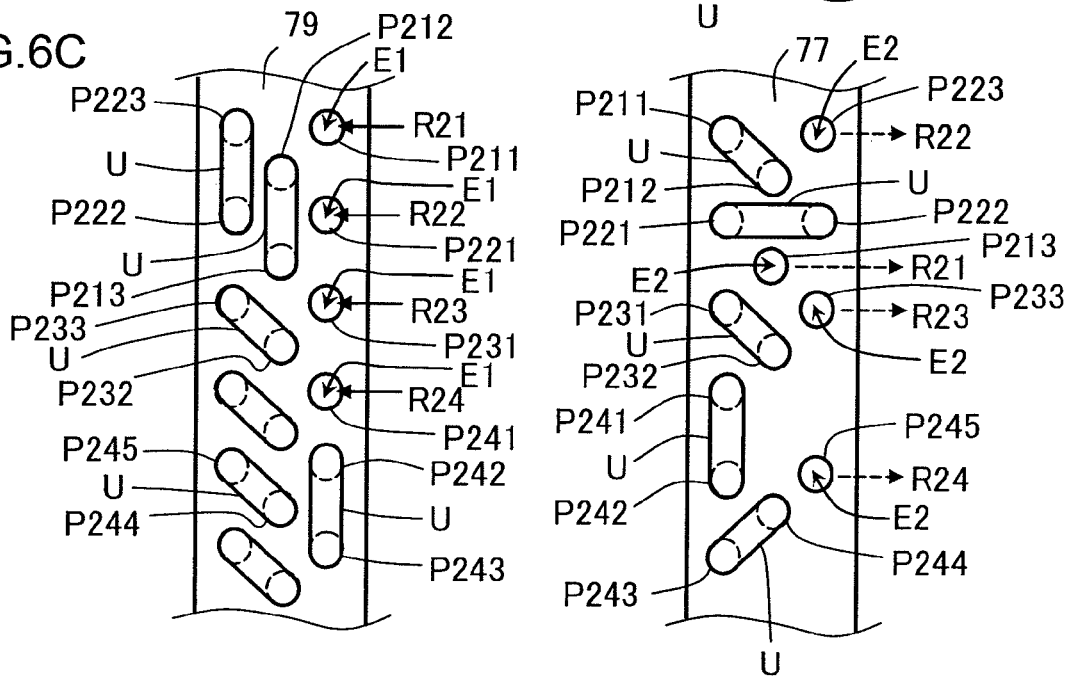

On the other hand, with a conventional heat exchanger, there are only a plurality of refrigerant tubes having an even number of heat transfer tube portions P as shown in FIG. 6B or there are only a plurality of refrigerant tubes having an odd number of heat transfer tube portions P as shown in FIG. 6C. A specific description will now be given.

As shown in FIG. 6B, a refrigerant tube R11 is constituted by heat transfer tube portions P111 to P116 and a plurality of bent portions U that connect the heat transfer tube portions P to each other on a side of a front tube plate 77 or a rear tube plate 79. The refrigerant tube R11 comprises an even number of (six) heat transfer tube portions P. A refrigerant tube R12 is constituted by heat transfer tube portions P121 to P124 and a plurality of bent portions U that connect the heat transfer tube portions P to each other on a side of the front tube plate 77 or the rear tube plate 79. The refrigerant tube R12 comprises an even number of (four) heat transfer tube portions P.

With the refrigerant tubes R11 and R12, since the open end portions E1 and E2 are both provided on the front tube plate 77, the plurality of refrigerant tubes R are invariably even multiples of the effective length L.

As shown in FIG. 6C, a refrigerant tube R21 is constituted by heat transfer tube portions P211 to P213 and a plurality of bent portions U that connect the heat transfer tube portions P to each other on the side of the front tube plate 77 or the rear tube plate 79. The refrigerant tube R21 comprises an odd number of (three) heat transfer tube portions P. A refrigerant tube R22 is constituted by heat transfer tube portions P221 to P223 and a plurality of bent portions U that connect the heat transfer tube portions P to each other on the side of the front tube plate 77 or the rear tube plate 79. The refrigerant tube R22 comprises an odd number of (three) heat transfer tube portions P. A refrigerant tube R23 is constituted by heat transfer tube portions P231 to P233 and a plurality of bent portions U that connect the heat transfer tube portions P to each other on the side of the front tube plate 77 or the rear tube plate 79. The refrigerant tube R23 comprises an odd number of (three) heat transfer tube portions P. A refrigerant tube R24 is constituted by heat transfer tube portions P241 to P245 and a plurality of bent portions U that connect the heat transfer tube portions P to each other on the side of the front tube plate 77 or the rear tube plate 79. The refrigerant tube R24 comprises an odd number of (five) heat transfer tube portions P.

With the refrigerant tubes R21 to R24, since open end portions E1 are all provided on the rear tube plate 79 and open end portions E2 are all provided on the front tube plate 77, the plurality of refrigerant tubes R are invariably odd multiples of the effective length L.

Figure 7:
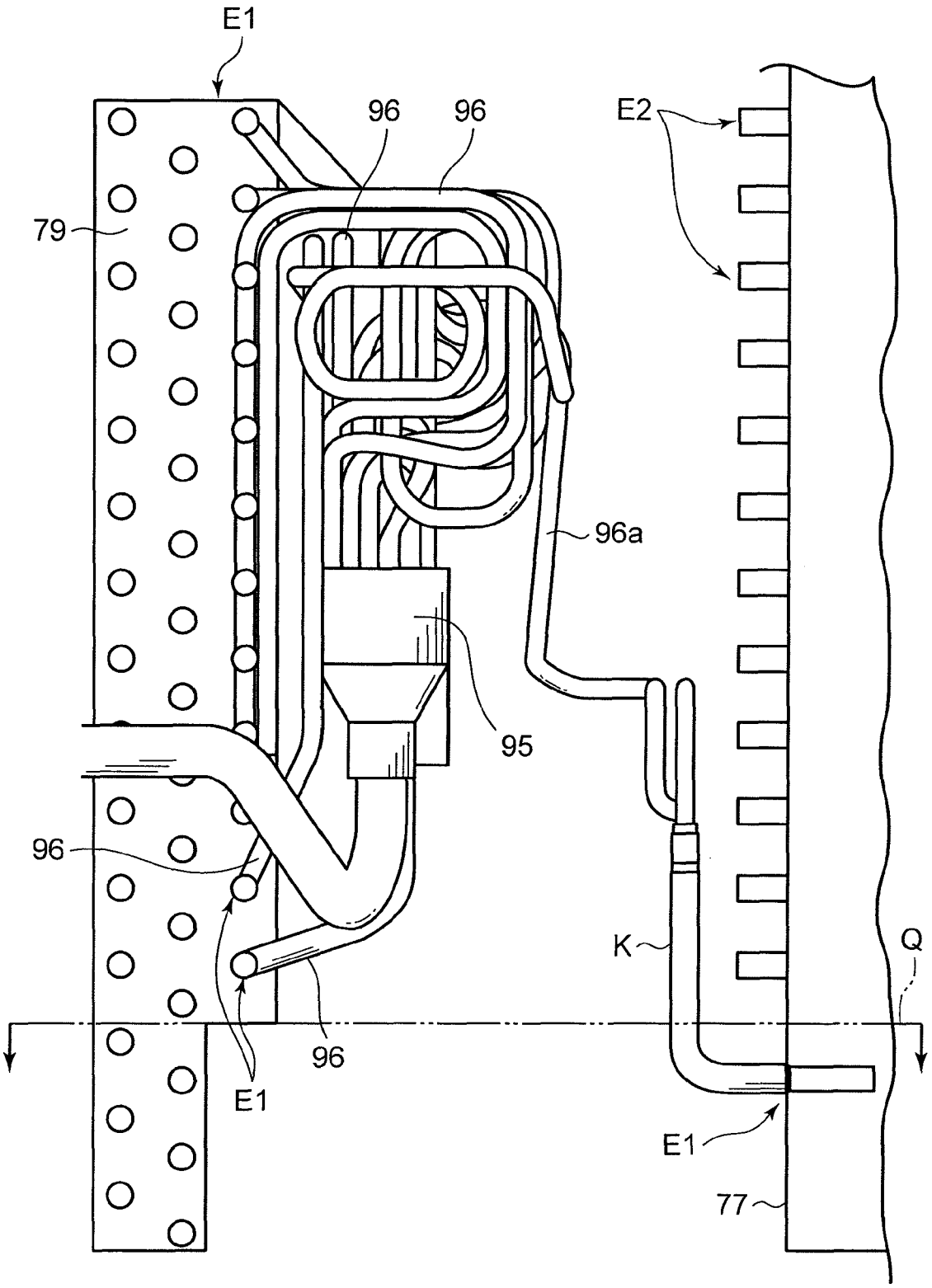
FIG. 7 is a detailed side view showing a connection destination of each branching tube of a flow divider in a heat exchanger according to the embodiment.

FIG. 7 is a detailed side view showing an example of connection destinations of the respective branching tubes 96 of the flow divider 94 in the heat exchanger 71 according to the present embodiment. In FIG. 7, the header 91, the bent tube portions U, and the like are not shown.

As shown in FIG. 7, among the plurality of capillary tubes 96 that branch from the flow divider main body 95, one capillary tube 96*a* is connected to an open end portion E1 positioned at a lower part of the front tube plate 77, and other capillary tubes 96 are respectively connected to open end portions E1 provided on the rear tube plate 79. In addition, as shown in FIG. 7, in the heat exchanger 71, three rows of heat transfer tube portions P are arranged to a position of a two-dot chain line Q, while an innermost row is omitted and only the two outer rows are arranged below the two-dot chain line Q.

Furthermore, in the present embodiment, the capillary tube 96*a* (96) connected to the open end portion E1 of the refrigerant tube R3 with a long flow channel length is subject to a greater pressure loss during refrigerant flow than the branching tubes 96 connected to the open end portions E1 of the refrigerant tubes R1 and R2 with shorter flow channel lengths. Methods of increasing the pressure loss of the branching tube 96, for example, include increasing a length of the branching tube 96 itself and reducing an inner diameter of the branching tube itself.

In addition, as shown in FIG. 2, the heat exchanger 71 according to the present embodiment is arranged in a state where the heat exchanger 71 rises upward from the drain pan 45. The drain pan 45 comprises a bottom portion 45*a* and a pair of side wall portions 45*b* that extends upward from both sides of the bottom portion 45*a*. Therefore, since the heat exchanger 71 is arranged so that a lower part of the heat exchanger 71 opposes the side wall portions 45*b* of the drain pan 45, the drain pan 45 obstructs a smooth flow of air at the lower part of the heat exchanger 71. As a result, at the lower part of the heat exchanger 71, air is likely to pass through the heat exchanger 71 at a lower wind speed than in other portions (for example, near a center in a height direction) and heat exchanging efficiency may decline.

In consideration thereof, in the present embodiment, refrigerant tubes R provided in the lower part of the heat exchanger 71 or in nearby portions thereof have a larger number of heat transfer tube portions P than refrigerant tubes R in other portions. Specifically, as shown in FIG. 6A, the refrigerant tube R3 positioned in the lower part of the heat exchanger 71 uses four heat transfer tube portions P, and the refrigerant tubes R1 and R2 positioned above the refrigerant tube R3 use three heat transfer tube portions P. As shown, since the number of heat transfer tube portions P used in the refrigerant tubes R can be finely set in the present embodiment, the refrigerant tubes R can be adjusted to a more appropriate length in accordance with wind speeds of air that differ from portion to portion in the heat exchanger 71.

Figure 8A:
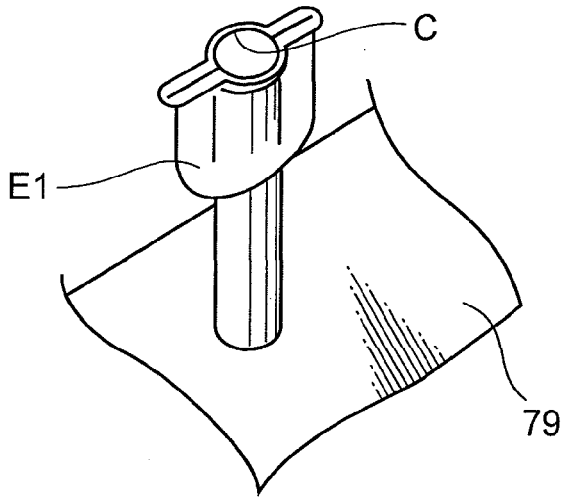
FIG. 8A is a perspective view showing an open end portion of a refrigerant tube at a rear tube plate.
Figure 8B:
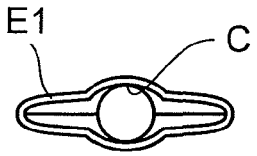
FIG. 8B is a front view of the open end portion.
Figure 9A:
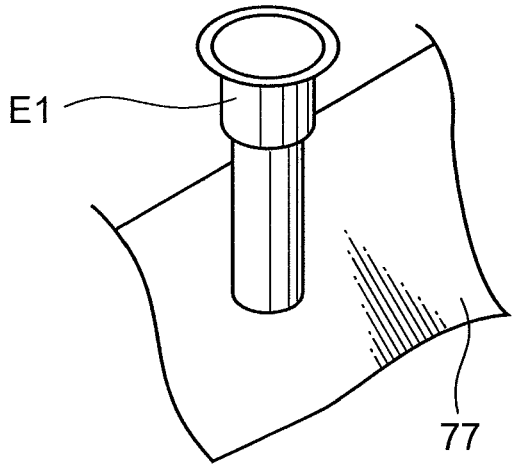
FIG. 9A is a perspective view showing an open end portion of a refrigerant tube at a front tube plate.

Next, a structure of the capillary tubes 96 of the flow divider 94 will be described in detail. The open end portion E1 on the side of the rear tube plate 79 to which the capillary tube 96*a* is connected and the open end portion E1 on the side of the front tube plate 77 to which the other capillary tubes 96 are connected are formed in shapes that differ from each other. As shown in FIGS. 8A and 8B, the open end portion E1 on the side of the rear tube plate 79 is structured as a flat shape having both sides crushed. On the other hand, as shown in FIG. 9A, the open end portion E1 on the side of the front tube plate 77 has an expanded-diameter structure in which a diameter increases at a tip portion. Accordingly, an operator can avoid connecting each capillary tube 96 to a wrong connection destination during a connecting operation of the capillary tubes 96.

Figure 8C:
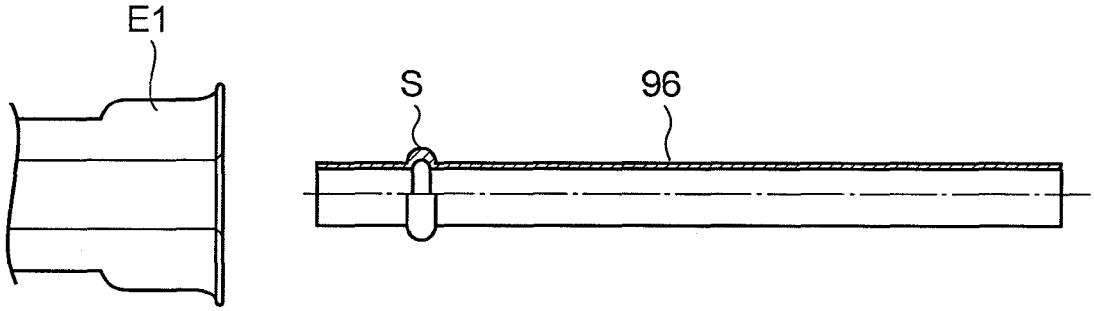
FIG. 8C is a side view before connecting a branching tube of the flow divider to the open end portion.
Figure 8D:
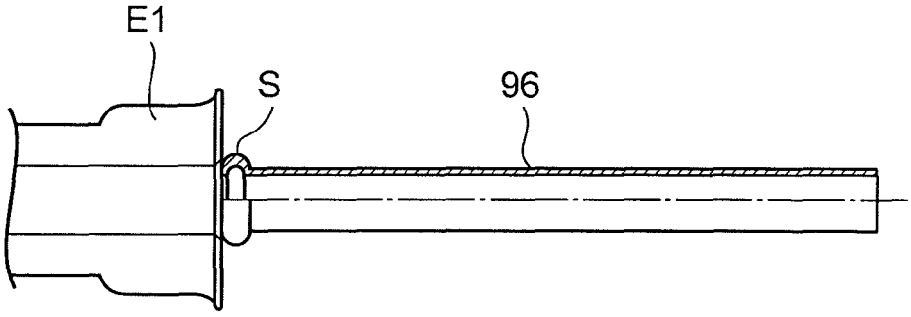
FIG. 8D is a side view after connecting a branching tube of the flow divider to the open end portion.

Moreover, a circular opening C to which the tip portion of the capillary tube 96 fits is formed near a center of the flat structure of the open end portion E1 on the side of the rear tube plate 79. As shown in FIG. 8C, a stopper S that is elevated from other portions is foamed in a vicinity of the tip portion of the capillary tube 96. Accordingly, when inserting the tip portion of the capillary tube 96 into the opening C, further insertion is regulated by the stopper S (FIG. 8D). The tip portion of the capillary tube 96 and the open end portion E1 are fixed by brazing. In FIGS. 8C and 8D, a part above a dashed line represents a sectional view and a part below the dashed line represents a side view.

Figure 9B:
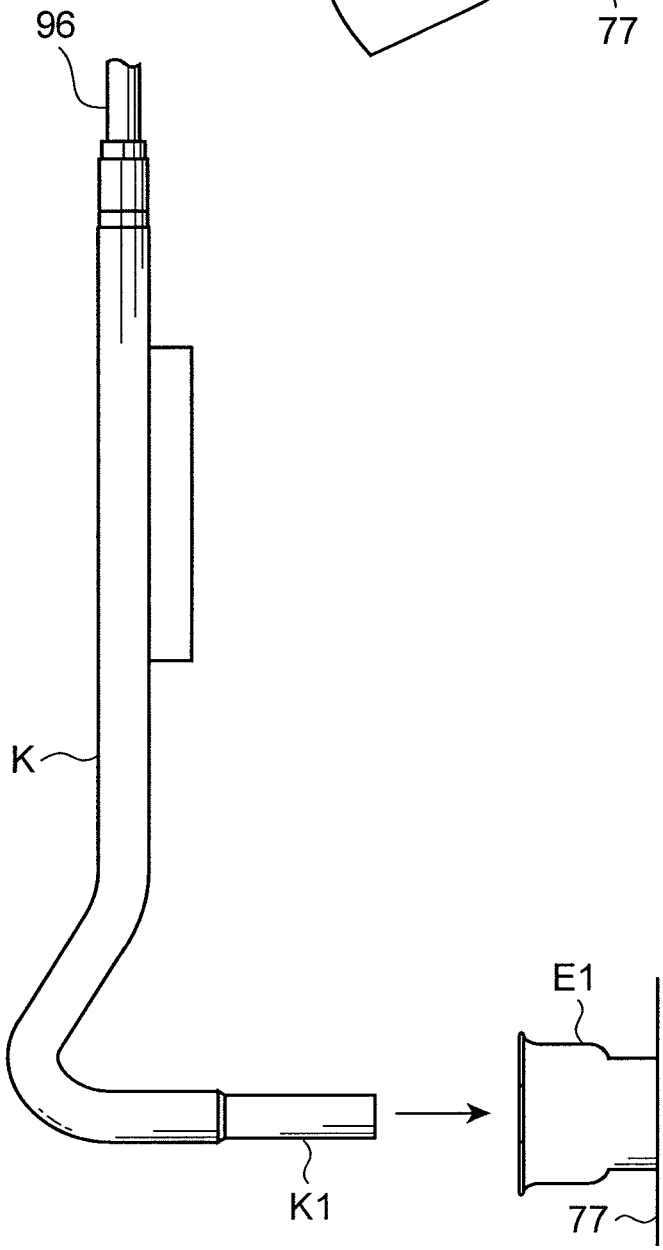
FIG. 9B is a side view showing a shape of a tip portion of a branching tube of the flow divider connected to the open end portion.
Figure 10:
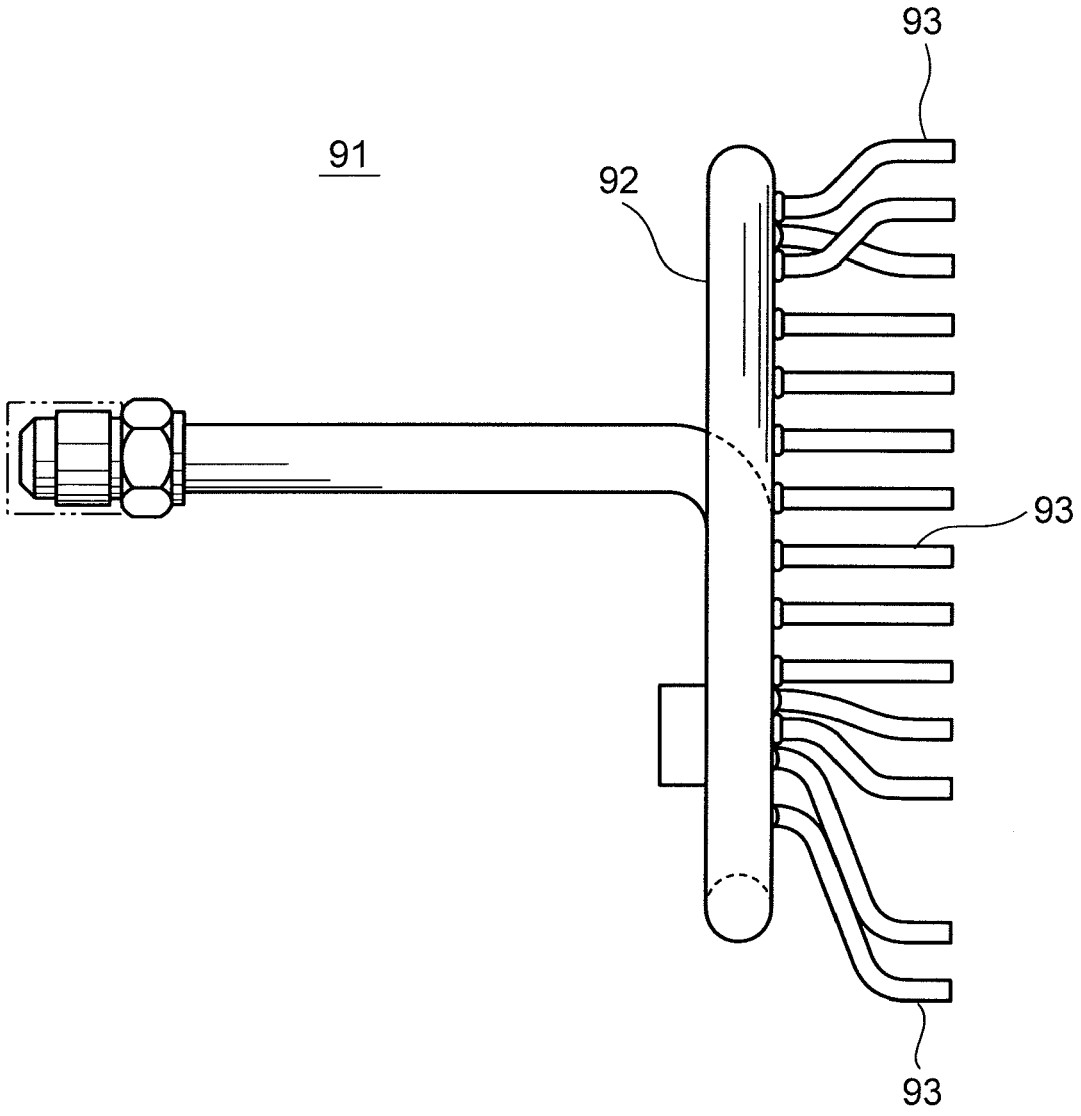
FIG. 10 is a side view showing a header.

In addition, as shown in FIG. 9B, an expanded-diameter piping K is connected to the tip portion of the capillary tube 96*a* so as to conform to the diameter of the open end portion E1 on the side of the front tube plate 77. A tip portion K1 of the piping K is connected and brazed to the open end portion E1.

Next, using a case of a cooling operation as an example, a flow of a refrigerant through the respective refrigerant tubes R1, R2, and R3 shown in FIG. 6A will be described. In the case of a cooling operation, the refrigerant is sent to the heat exchanger 71 through the piping 64 shown in FIG. 1. As shown in FIGS. 1 and 4, the refrigerant sent through the piping 64 flows into the flow divider main body 95 and branches into the plurality of capillary tubes 96, and reaches the open end portion E1 to which the respective branching tubes 96 are connected. The refrigerant having reached the open end portions E1 of the respective refrigerant tubes R passes through the heat transfer tube portions P and the bent portions U and reaches the open end portions E2 of the respective refrigerant tubes R, and merges into the header main body 92 through the branching tubes 93 of the header 91 connected to the respective open end portions E2. The refrigerant flows toward the four-way selector valve 86 through the piping 61 connected to the header main body 92.

<Summary of Embodiment>

The embodiment described above can be summarized as follows.

(1) In the heat exchanger described above, with the flow divider or the header, a part of the plurality of branching tubes is connected to the open end portion on the side of the one tube plate, and a remainder of the plurality of branching tubes is connected to the open end portion on the side of the other tube plate. Accordingly, the plurality of refrigerant tubes can comprise an even number refrigerant tube which includes an even number of the heat transfer tube portions and an odd number refrigerant tube which includes an odd number of the heat transfer tube portions.

As described earlier with reference to FIGS. 6B and 6C, with a conventional heat exchanger, an even number refrigerant tube having an even number of heat transfer tube portions and an odd number refrigerant tube having an odd number of heat transfer tube portions cannot coexist and the plurality of refrigerant tubes are either all even number refrigerant tubes or all odd number refrigerant tubes. In this case, if L denotes an effective length of a single heat transfer tube portion, when adjusting a flow channel length of each refrigerant tube for each portion in a conventional heat exchanger, a minimum unit of adjusting the flow channel length is a length corresponding to two heat transfer tube portions or, in other words, a length expressed as 2L.

On the other hand, with the present configuration, since a plurality of refrigerant tubes can comprise both even number refrigerant tubes and odd number refrigerant tubes, a minimum unit of adjusting a flow channel length of each refrigerant tube is a length corresponding to one heat transfer tube portion or, in other words, the length L. Accordingly, since a flow channel length can be adjusted more finely than in a conventional heat exchanger, a flow channel length of each refrigerant tube can be adjusted to a more appropriate length for each portion of the heat exchanger. Therefore, a heat exchanging performance of the heat exchanger can be finely adjusted for each portion of the heat exchanger. Furthermore, since a flow channel length can be adjusted in units of length L, an excessively large pressure loss due to an increase in a flow channel length can be suppressed in comparison to a conventional case where a flow channel length can only be adjusted in units of length 2L.

(2) Specifically, for example, among the even number refrigerant tube and the odd number refrigerant tube, whichever has the longer flow channel length of the refrigerant tube is favorably arranged at a portion at which air passes through the fins at a lower wind speed than a portion at which whichever has the shorter flow channel length of the refrigerant tube is arranged. Accordingly, since a heat exchanging efficiency in the portion with a low wind speed can be enhanced, a heat exchanging efficiency of the entire heat exchanger can also be enhanced.

(3) Favorably, a pressure loss during refrigerant flow in the branching tube connected to the open end portion of the refrigerant tube having the longer flow channel length is greater than a pressure loss during refrigerant flow in the branching tube connected to the open end portion of the refrigerant tube having the shorter flow channel length.

In this configuration, by adjusting the pressure loss in the branching tube, a distribution quantity (flow volume) of the refrigerant flowing into the refrigerant tube to which the branching tube is connected is adjusted. In other words, since the pressure loss during refrigerant flow in the branching tube connected to the open end portion of the refrigerant tube having the longer flow channel length is greater than the pressure loss during refrigerant flow in the branching tube connected to the open end portion of the refrigerant tube having the shorter flow channel length, in the branching tube connected to the open end portion of the refrigerant tube having the longer flow channel length, a flow resistance during the refrigerant flow increases. As a result, the distribution quantity (flow volume) of the refrigerant tube can be relatively reduced compared to the other refrigerant tubes. Accordingly, for example, in a heat exchanger, even in a case where a wind speed of air at a portion provided with a refrigerant tube with a long flow channel length is lower than a wind speed of air at other portions, a phase change of the refrigerant in the refrigerant tube can be further promoted.

(4) Favorably, the plurality of the branching tubes of the header are connected to the open end portion on the side of the one tube plate, a part of the plurality of the branching tubes of the flow divider is connected to the open end portion on the side of the one tube plate, a remainder of the plurality of the branching tubes of the flow divider is connected to the open end portion on the side of the other tube plate, and the number of the branching tubes of the flow divider which are connected to the open end portion on the side of the one tube plate is smaller than the number of the branching tubes of the flow divider which are connected to the open end portion on the side of the other tube plate.

In this configuration, since all of the branching tubes of the header are connected to the open end portion on the side of the one tube plate, by reducing the number of the branching tubes of the flow divider which are connected to the open end portion on the side of the one tube plate, overcomplication of the arrangement of the respective branching tubes at the one tube plate can be suppressed and connection mistakes and the like can be prevented.

<Other Embodiments>

While a description of an embodiment of the present invention has been presented above, the present invention is not limited to the embodiment described above and can be implemented in various modes. For example, while an example of a heat exchanger used in an indoor unit has been described in the embodiment above, the heat exchanger according to the present invention is also applicable to an outdoor unit.

In the embodiment described above, as shown in FIG. 4, a part of the plurality of the capillary tubes 96 of the flow divider 94 is connected to the open end portion of the front tube plate 77 and a remainder of the capillary tubes 96 is connected to the open end portion of the rear tube plate 79, and all of the plurality of branching tubes 93 of the header 91 are connected to the open end portion of the front tube plate 77. However, such a configuration is non-limiting. For example, a part of the plurality of the branching tubes 93 of the header 91 may be connected to the open end portion of the front tube plate 77 and a remainder of the branching tubes 93 may be connected to the open end portion of the rear tube plate 79.

Moreover, while a gas refrigerant flows into the header 91, a refrigerant that is a gas-liquid mixture flows into the flow divider 94. Therefore, the capillary tubes 96 of the flow divider 94 are structured so as to be smaller in diameter and more deformable than the branching tubes 93 of the header 91. Therefore, favorably, the plurality of branching tubes 93 of the header 91 are connected to the open end portion of any one of the front tube plate 77 and the rear tube plate 79 in a concentrated manner, and the plurality of capillary tubes 96 of the flow divider 94 are divided between those connected to the open end portion of the front tube plate 77 and those connected to the open end portion of the rear tube plate 79. Dividedly connecting the plurality of capillary tubes 96 of the flow divider 94 in this manner improves operability and workability.

In addition, while the number of heat transfer tube portions P constituting the refrigerant tube R at the lower part of the heat exchanger 71 which is positioned in the vicinity of the drain pan 45 is set higher than other portions, for example, a wind speed of air tends to be lower in a vicinity of an inner surface of the chassis such as an inner surface of the top plate in comparison to near a center of the heat exchanger 71 in the height direction. Therefore, the number of heat transfer tube portions P constituting the refrigerant tubes R in the vicinity of the inner surface of the chassis may be set higher than other portions (such as near the center). Accordingly, heat exchanging efficiency can even be improved in the vicinity of the inner surface of the chassis.

Furthermore, while a case in which only one capillary tube among the plurality of capillary tubes of the flow divider is connected to the open end portion provided on the front tube plate has been described in the embodiment above, two or more capillary tubes may be connected to the open end portion of the front tube plate.

EXPLANATION OF REFERENCE NUMERALS

31 indoor unit
71 heat exchanger
73 fin
77 front tube plate
79 rear tube plate
91 header
92 header main body
93 branching tube
94 flow divider
95 flow divider main body
96 capillary tube (branching tube)
P heat transfer tube portion
P11 to P13 heat transfer tube portion of refrigerant tube R1
P21 to P23 heat transfer tube portion of refrigerant tube R2
P31 to P34 heat transfer tube portion of refrigerant tube R3
R (R1, R2, R3) refrigerant tube
U bent portion

The invention claimed is:

1. A heat exchanger used in an air conditioner, the heat exchanger comprising:

a plurality of fins disposed so that adjacent fins oppose each other;

a first tube plate positioned at one end side of the plurality of fins in a direction of disposition of the plurality of fins;

a second tube plate positioned at another end side of the plurality of fins opposite to the one end side;

a first refrigerant tube having formed therein a total number of heat transfer tube portions extending from the first tube plate to the second tube plate by penetrating the plurality of fins, which is equal to an odd number greater than one, and having formed therein a plurality of bent tube portions each of which connects end portions of two of the heat transfer tube portions to each other, the first refrigerant tube having a first open end portion positioned on the first tube plate side and a second open end portion positioned on the second tube plate side, the first refrigerant tube forming a single passage from the first open end portion to the second open end portion;

a second refrigerant tube having formed therein a total number of heat transfer tube portions extending from the first tube plate to the second tube plate by penetrating the plurality of fins, which is equal to an even number, and having formed therein a plurality of bent tube portions each of which connects end portions of two of the heat transfer tube portions to each other, the second refrigerant tube having a first open end portion positioned on the first tube plate side and a second open end portion positioned on the first tube plate side, the second refrigerant tube forming a single passage from the first open end portion of the second refrigerant tube to the second open end portion of the second refrigerant tube;

a flow divider having a flow divider main body which is connected to a piping in which a refrigerant in the air conditioner flows and a plurality of branching tubes which branch from the flow divider main body; and a header having a header main body which is connected to a second piping in which the refrigerant in the air conditioner flows and a plurality of branching tubes which branch from the header main body, wherein the plurality of branching tubes of the flow divider include:

a branching tube connected to one of the first open end portion and the second open end portion of the first refrigerant tube, which is an inlet of a refrigerant in the first refrigerant tube; and another branching tube connected to one of the first open end portion and the second open end portion of the second refrigerant tube, which is an inlet of a refrigerant in the second refrigerant tube, and the plurality of branching tubes of the header include:

a branching tube connected to one of the first open end portion and the second open end portion of the first refrigerant tube, which is an outlet of a refrigerant in the first refrigerant tube, and another branching tube connected to one of the first open end portion and the second open end portion of the second refrigerant tube, which is an outlet of a refrigerant in the second refrigerant tube.

2. The heat exchanger according to claim 1, wherein one of the first refrigerant tube and the second refrigerant tube has a longer flow channel length than the other, and is arranged at a portion at which air passes through the fins at a lower wind speed than a portion at which the one of the first refrigerant tube and the second refrigerant tube having the shorter flow channel length is arranged, and wherein the flow channel length of the refrigerant tube is a total value of a value obtained by multiplying a length of the heat transfer tube portion by the number of the heat transfer tube portions and a value obtained by multiplying a length of the bent tube portion by the number of the bent tube portions.

3. The heat exchanger according to claim 2, wherein a pressure loss during refrigerant flow in the branching tube connected to the open end portion of the refrigerant tube having the longer flow channel length is greater than a pressure loss during refrigerant flow in the branching tube connected to the open end portion of the refrigerant tube having the shorter flow channel length.

4. The heat exchanger according to claim 1, wherein the plurality of the branching tubes of the header are connected to the open end portion positioned on the first tube plate side, and a part of the plurality of the branching tubes of the flow divider is connected to the open end portion positioned on the first tube plate side, a remainder of the plurality of the branching tubes of the flow divider is connected to the open end portion positioned on the second tube plate side, and the number of the branching tubes of the flow divider which are connected to the open end portion positioned on the first tube plate side is smaller than the number of the branching tubes of the flow divider which are connected to the open end portion positioned on the second tube plate side.

5. The heat exchanger according to claim 1, wherein the heat exchanger is configured to adjust the flow channel length of the refrigerant tube by the length of one heat transfer tube portion.

* * * * *